US007366449B2

(12) United States Patent
Zemba

(10) Patent No.: US 7,366,449 B2
(45) Date of Patent: Apr. 29, 2008

(54) DEVELOPING UNIT, PROCESS CARTRIDGE, AND IMAGE FORMING APPARATUS

(75) Inventor: Hideki Zemba, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 214 days.

(21) Appl. No.: 11/126,286

(22) Filed: May 11, 2005

(65) Prior Publication Data

US 2005/0271424 A1 Dec. 8, 2005

(30) Foreign Application Priority Data

Jun. 3, 2004 (JP) ..... 2004-165318

(51) Int. Cl.
*G03G 15/06* (2006.01)

(52) U.S. Cl. ..... 399/222; 399/254; 399/256

(58) Field of Classification Search ..... 399/254, 399/256, 102

See application file for complete search history.

(56) References Cited

U.S. PATENT DOCUMENTS

2002/0106222 A1 8/2002 Chadani et al.

FOREIGN PATENT DOCUMENTS

CN 1217489 A 5/1999
CN 1490683 A 4/2004
EP 1 403 742 A2 3/2004
JP 2002-287472 10/2002
JP 2003-5517 1/2003

OTHER PUBLICATIONS

Machine Translation JP 2002287472 A Oct. 2002 Japan.*
Irie et al., JP 2003005517 A, Jan. 8, 2003, Machine Translation.*
U.S. Appl. No. 11/372,142, filed Mar. 10, 2006, Zemba.

* cited by examiner

*Primary Examiner*—David M. Gray
*Assistant Examiner*—David A Blackshire
(74) *Attorney, Agent, or Firm*—Oblon, Spivak, McClelland, Maier & Neustadt, P.C.

(57) ABSTRACT

A developing unit includes a developer container that includes an opening and holds a developer; a first screw that stirs and conveys the developer, and that supplies the developer to a developing roller; a second screw that stirs the first developer, and that conveys the developer to a direction opposite to a direction to which the first screw conveys the developer; and a partition wall that partitions between the first screw and the second screw. The partition wall includes a guiding member that guides, to a position within a range in which rotation of the first conveying unit reaches, a part of the developer that is supplied to the developing roller and is returned after being used for development from the developing roller, and at least a part of the guiding member is an adhesion surface to which a sealing member for sealing the opening is adhered.

6 Claims, 5 Drawing Sheets

DEVELOPING UNIT, PROCESS CARTRIDGE, AND IMAGE FORMING APPARATUS

CROSS-REFERENCE TO RELATED APPLICATIONS

The present document incorporates by reference the entire contents of Japanese priority document, 2004-165318 filed in Japan on Jun. 3, 2004.

BACKGROUND OF THE INVENTION

1) Field of the Invention

The present invention relates to a developing unit, which is used in copying machines, facsimile machines, and printers, and to a process cartridge and an image forming apparatus.

2) Description of the Related Art

Conventionally, a two-component developing unit is used to develop a latent image formed on an image carrier. In the two-component developing unit, a two-component developer that includes a toner and a carrier is used as a developer. The two-component developing unit includes a developer stirring and conveying member that is disposed in a developer container to stir the two-component developer, thereby frictionally charging the toner. In general, the developer stirring and conveying member has a structure in which spiral screw blades are provided around a rotation axis. The developer is carried on a surface of a developer carrying member that includes a magnetic pole inside, and is supplied to an electrostatic latent image on the image carrier to develop the latent image. A concentration of the toner in the two-component developer changes during use because the toner is consumed during development. Therefore, it is necessary to replenish the toner corresponding to a change in the concentration to keep the concentration constant, thereby maintaining a quality of images to be formed.

However, when a solid image is successively printed with the two-component developing unit, unevenness is sometimes caused in an image. Such unevenness is called screw pitch unevenness, and the screw pitch unevenness is caused due to insufficiently mixed developer. A developer that is returned to the developer container from the developer carrying member after contributing to development has a low concentration of the toner. The developer returned and a developer that is newly conveyed by the developer stirring and conveying member from the developer container are conveyed together to a developer controlling member without being sufficiently mixed. As a countermeasure against such a problem, fins (paddles) are formed at specific positions on the screw blade to improve a stirring effect of the developer stirring and conveying member. However, this method causes fin pitch unevenness. The fin pitch unevenness occurs because the developer returned is held by the fins, and is conveyed to the developer controlling member without being mixed with the developer newly conveyed from the developer container.

Japanese Patent Application Laid-open No. 2002-287472 discloses a developing unit that includes a developer guiding member. The developer guiding member guides the developer returned form the developer carrying member after development to be within a range in which rotation of the developer stirring and conveying member reaches. With the developer guiding member, the developer returned is more likely to be taken out to the developer stirring and conveying member, instead of staying in the developer container. Thus, the developer having a low concentration of the toner, which is returned to the developer container after development, and a developer never used for development are more effectively mixed in the developer container. As a result, occurrence of the screw pitch unevenness can be suppressed.

When a new developing unit or a new process cartridge including a developing unit is installed or replaced with a new developing unit or a new process cartridge, a sealing member is peeled off from a new developer container before installation or replacement. When an image forming apparatus carrying this new process cartridge is driven, a developer in the developer container passes through the developer controlling member, and is conveyed to the developer carrying member. The sealing member prevents degradation of the developer due to exposure to an atmosphere, a foreign material to be mixed into the developer in the developer container. The sealing member also prevents leak of the developer from the developer container during movement or conveyance of the developing unit. For this sealing member, in the developer container, a surface to which the sealing member is adhered should be sufficiently provided to secure hermeticity.

In recent years, a new type of a toner manufactured by polymerization is used. Such toner is formed to have a particle size within a range of 3 micrometers (μm) to 10 μm in high precision, and a shape of the toner can be controlled. On the other hand, this toner tends to have high fluidity due to an amount of an additive. Therefore, the developer container is required to have even higher hermeticity.

SUMMARY OF THE INVENTION

It is an object of the present invention to at least solve the problems in the conventional technology.

A developing unit according to one aspect of the present invention includes a developer carrying member that is in the form of a roller and that carries a first developer that contains a toner and a carrier; a developer container that includes an opening and holds the first developer; a developer controlling member that controls an amount of a second developer that is a part of the first developer to be supplied from the developer container to the developer carrying member; a first conveying member that is in the form of a roller, that is rotatably arranged in the developer container and substantially parallel to the developer carrying member, and that stirs and conveys the first developer in the developer container to the developer carrying member; a second conveying member that is in the form of a roller, that is rotatably arranged in the developer container and substantially parallel to the first conveying member, and that stirs and conveys the first developer to a direction opposite to a direction to which the first conveying member conveys the first developer; and a partition wall arranged between the first conveying member and the second conveying member. The partition wall includes a guiding member that guides, to a position within a range in which rotation of the first conveying unit reaches, a third developer that is a part of the second developer returned after being used for development from the developer carrying member, and at least a part of the guiding member is an adhesion surface to which a sealing member for sealing the opening is adhered.

A process cartridge according to another aspect of the present invention is used in an image forming apparatus that includes an image carrier that carries an image; a charging unit that uniformly charges the image carrier; a developing unit that develops a latent image on the image carrier and that includes the above aspects; and a cleaning unit that cleans a residual toner remaining on the image carrier after development, and integrates the developing unit with at least one of the image carrier, the charging unit, and the cleaning unit. The process cartridge is detachable to the image forming apparatus An image forming apparatus according to still another aspect of the present invention includes an image carrier; an image forming unit that forms a latent image on the image carrier; and a developing unit that develops the latent image, and that includes the above aspects.

The other objects, features, and advantages of the present invention are specifically set forth in or will become apparent from the following detailed description of the invention when read in conjunction with the accompanying drawings.

DETAILED DESCRIPTION

Figure 1:
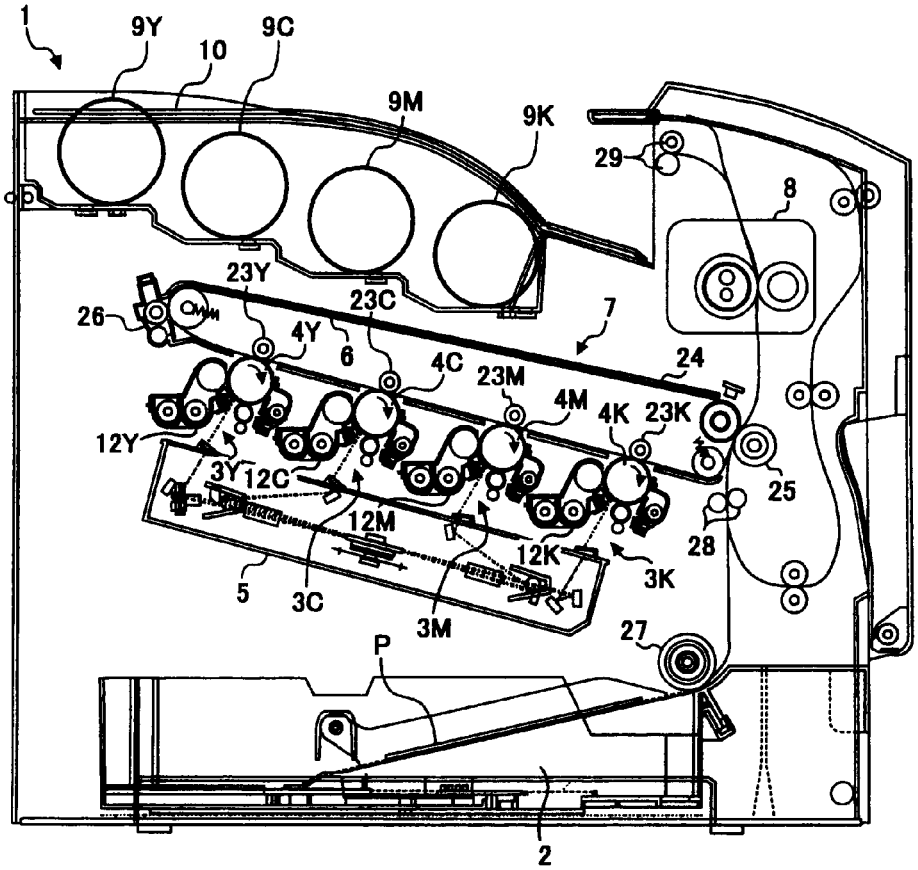
FIG. 1 is a schematic of a printer according to an embodiment of the present invention.

Exemplary embodiments of the present invention will be explained below in detail with reference to the accompanying drawings. FIG. 1 is a schematic of a printer according to an embodiment of the present invention. As shown in FIG. 1, the printer includes a main unit 1 and a paper feeding cassette 2. In the main unit 1 of which a position is fixed, constituent members of an image forming apparatus are arranged. The paper feeding cassette holds transfer paper P as a recording material. The main unit 1 has image stations 3Y, 3C, 3M, and 3K that form toner images of yellow (Y), cyan (C), magenta (M), and black (K), respectively, at the center of the main unit. Characters Y, C, M, and K attached to reference signs indicate yellow, cyan, magenta, and black members, respectively. The printer includes an optical unit 5 as an exposing unit that irradiates a laser beam to drum-shaped photosensitive elements 4Y, 4C, 4M, and 4K, below the image stations 3Y, 3C, 3M, and 3K, respectively. The printer includes, above the image stations 3, an intermediate transfer unit 7 that includes an intermediate transfer belt 6 on which toner images formed by a corresponding image station 3 among the image stations 3Y, 3C, 3M, and 3K are secondarily transferred. The printer includes a fixing unit 8 that fixes a toner image transferred to the intermediate transfer belt 6, on the transfer paper P. Toner bottles 9Y, 9C, 9M, and 9K that holds toners of yellow (Y), cyan (C), magenta (M), and black (K) respectively are mounted at an upper part of the main unit 1. The toner bottles 9Y, 9C, 9M, and 9K are detachable, and are possible to be removed from the main unit 1 when by opening a paper discharge tray 10 that is formed at an upper part of the main unit 1.

Figure 2:
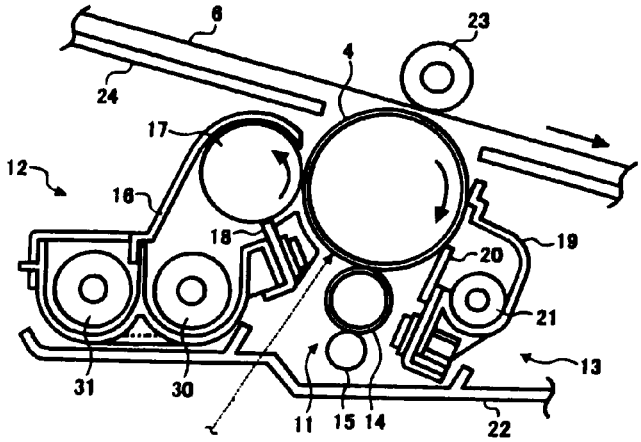
FIG. 2 is a schematic of an image station of the printer shown in FIG. 1.

Each of the image stations 3Y, 3C, 3M, and 3K has an identical configurations. Therefore, only one of the image stations 3 is explained. FIG. 2 is a schematic of the image station 3. As shown in FIG. 2, the image station 3 includes a photosensitive element 4, a charging unit 11 that charges the photosensitive element 4, a developing unit 12 that develops a latent image formed on the photosensitive element 4, and a cleaning unit 13 that cleans a residual toner remaining on the photosensitive element 4. The charging unit 11 includes a charging roller 14, and a cleaning roller 15 that cleans the surface of the charging roller 14. The developing unit 12 includes a developer case 16 that has an opening. The developing unit 12 includes a developing roller 17 as a developer carrying member that is disposed closely opposite to a surface of the photosensitive element 4, and a doctor blade 18 as a developer controlling member that controls an amount of a developer to be carried on the developing roller 17, that are arranged in the developer case 16. The cleaning unit 13 consists of a cleaning case 19 that has an opening, a cleaning blade 20 that cleans the surface of the photosensitive element 4, and a waste toner screw 21 that conveys a waste toner cleaned from the photosensitive element 4 to a waste toner bottle (not shown).

Figure 3:
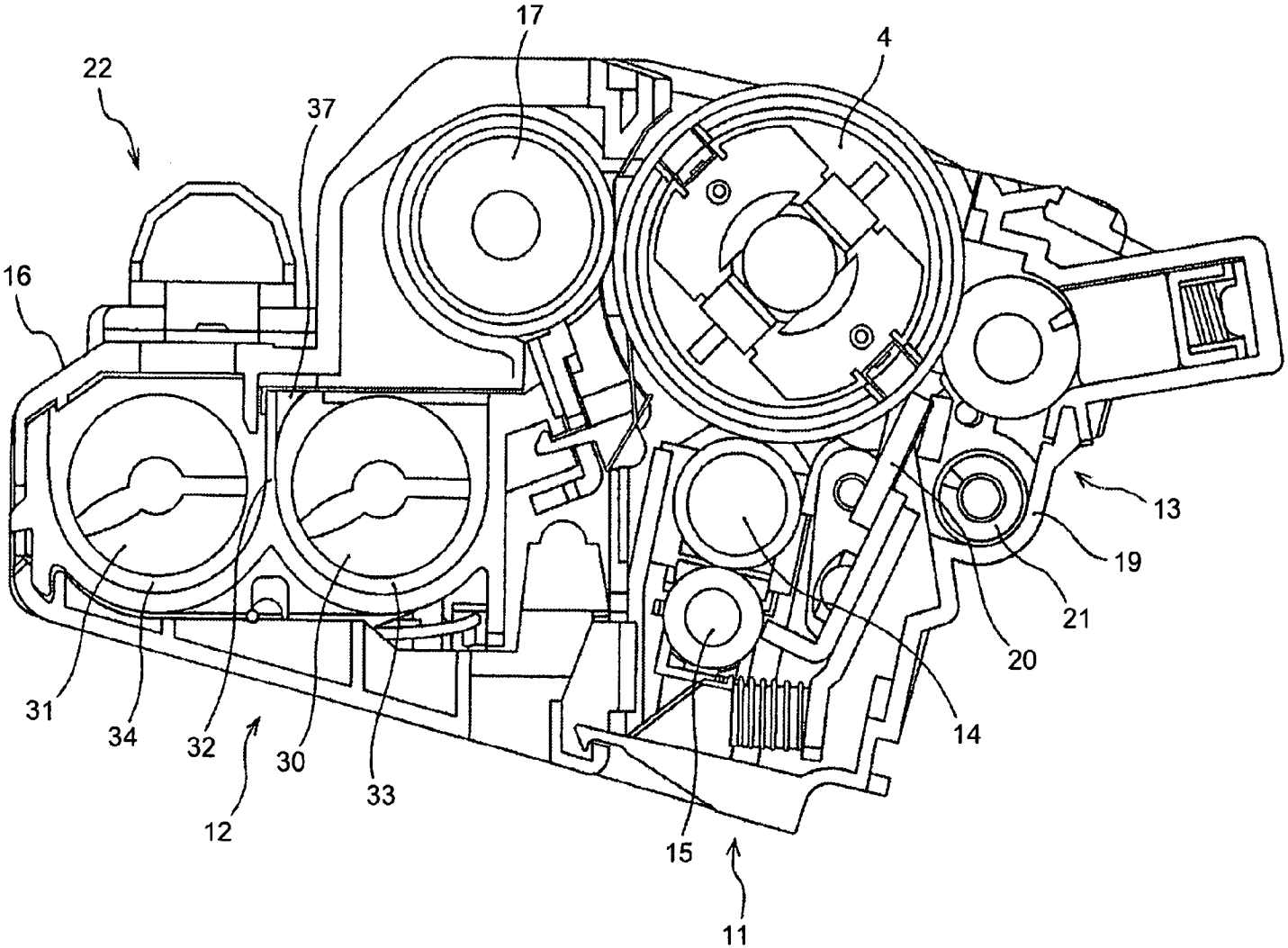
FIG. 3 is a schematic of a process cartridge of the printer shown in FIG. 1.
Figure 4:
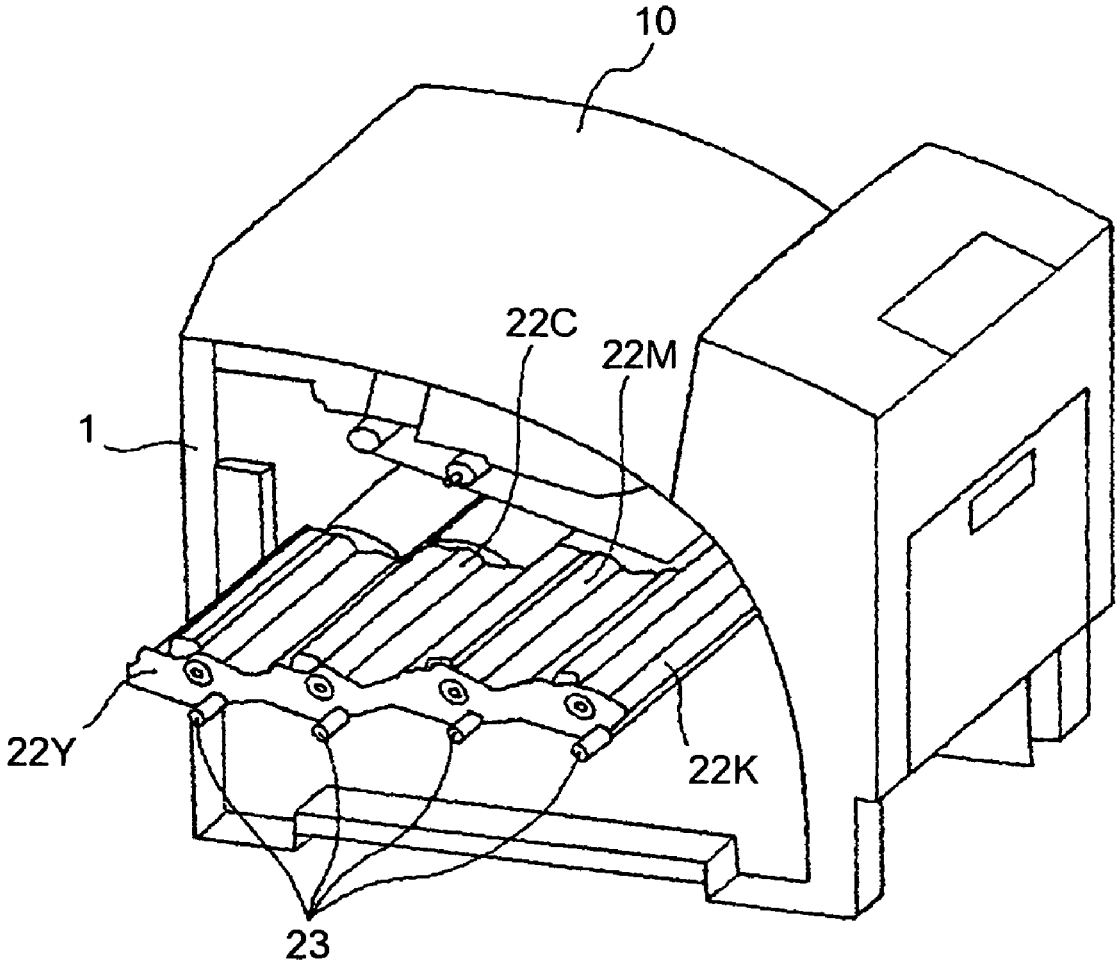
FIG. 4 is a perspective view of the printer for explaining removal of the process cartridge.

FIG. 3 is a schematic of a process cartridge. As shown in FIG. 3, the image station 3 integrally supports the photosensitive element 4, the charging unit 11, the developing unit 12, and the cleaning unit 13, and is configured as a process cartridge 22 detachable to the main unit 1. FIG. 4 is a schematic for explaining removal of the process cartridge 22 from the main unit 1. As shown in FIG. 4, a user can easily take out the process cartridge 22 from the main unit, by drawing knobs 23. The user can exchange the photosensitive element 4, the developing unit 12, the charging unit 11, or the cleaning unit 13, in a form of a cartridge.

As shown in FIG. 1, the intermediate transfer unit 7 includes an intermediate transfer belt 6 that is extended to plural rollers, and primary transfer rollers 23Y, 23C, 23M, and 23K that transfer toner images on the photosensitive elements 4Y, 4C, 4M, and 4K onto the intermediate transfer belt 6, respectively. These parts are integrally supported by an intermediate transfer belt case 24. The intermediate transfer unit 7 includes a secondary transfer roller 25 that transfers a toner image transferred to the intermediate transfer belt 6, onto the transfer paper P, and a belt cleaning unit 26 that cleans a toner not transferred to the transfer paper P and remaining on the intermediate transfer belt 6.

A paper feeding roller 27 disposed near the paper feeding cassette 2 conveys the transfer paper P to a secondary transfer unit between the intermediate transfer belt 6 and the secondary transfer roller 25. A pair of resist rollers 28 that adjusts timing for sending the recording paper P to the secondary transfer unit is disposed on a transfer paper conveying route between the paper feeding roller 27 and the secondary transfer roller 25.

The fixing unit 8 fixes a toner image transferred onto the transfer paper P, by applying heat and pressure to the toner image. A pair of discharge rollers 29 discharges the transfer paper P, on which the toner image is fixed, to the paper discharge tray 10.

The charging unit 11 uniformly charges the photosensitive element 4 at the image stations 3Y, 3C, 3M, and 3K. The optical unit 5 then emits a laser beam to the surface of the photosensitive element 4 to scan and expose the surface to form a latent image on the photosensitive element 4 based on image information. The developing unit 12 develops the latent image on the photosensitive element 4 using the color toners held on the developing roller 17 of the developing unit 12, thereby forming a visible toner image. The toner image on the photosensitive element 4 is sequentially transferred in superimposition onto the intermediate transfer belt 6 that is rotated in the counterclockwise direction in FIG. 4 based on the operation of each primary transfer bias roller 23. In this case, an image of each color is formed at different timing on the intermediate transfer belt 6 in a direction from an upstream to a downstream of movement of the belt, such that the toner image is transferred in superimposition on the same position of the intermediate transfer belt 6. The cleaning unit 13 cleans the surface of the photosensitive element 4 after the primary transfer, to prepare for the next image formation.

On the other hand, the paper feeding roller 27 disposed near the paper feeding cassette 2 conveys the transfer paper P into the main unit 1. The pair of resist rollers 28 conveys the transfer paper P to the secondary transfer unit at predetermined timing. The secondary transfer unit transfers the toner image formed on the intermediate transfer belt 6 to the transfer paper P. The transfer paper P to which the toner image is transferred passes through the fixing unit 8. The fixing unit 8 fixes the toner image on the transfer paper P. The discharging roller 29 discharges the transfer paper P to the paper discharge tray 10. The belt cleaning unit 26 that is in contact with the intermediate transfer belt 6 cleans a residual toner that remains on the transfer belt 6, in a similar manner to that of cleaning the residual toner remaining on the photosensitive element 4. The toner filled in the toner bottle 9 is replenished by a predetermined quantity to the developing units 12 of the image stations 3Y, 3C, 3M, and 3K, respectively, through a conveying route (not shown), as necessary.

Figure 5:
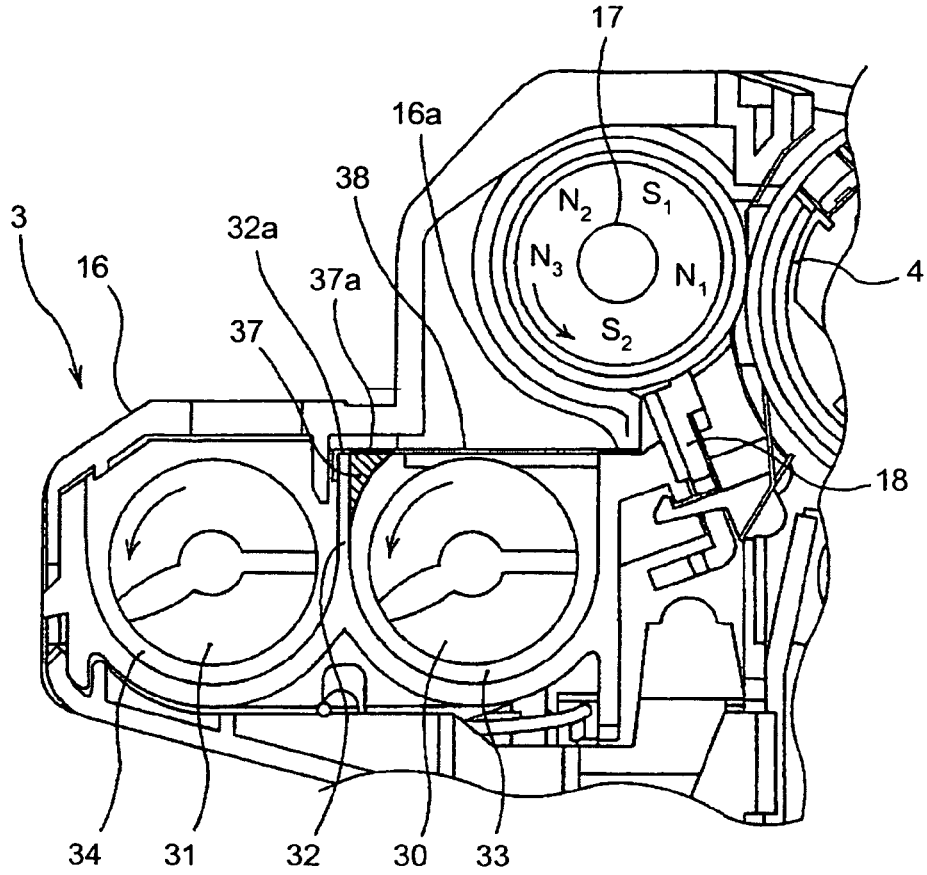
FIG. 5 is a schematic of a developing unit of the printer shown in FIG. 1.
Figure 6:
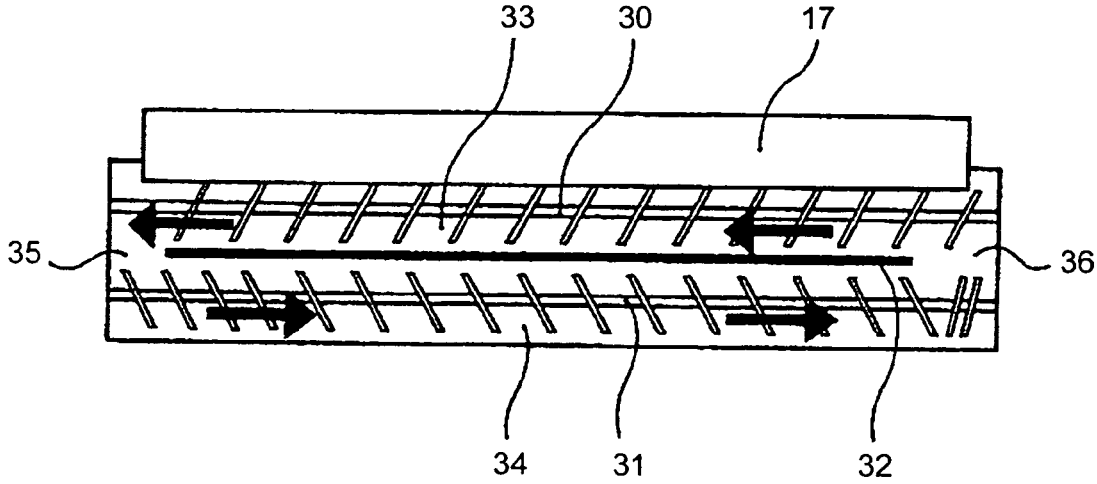
FIG. 6 is a plan view of the developing unit.

Each of the developing units 12Y, 12M, 12C, and 12K has identical configurations, except for a color of the toner to be used. Therefore, the configuration of only one of the developing units 12 is explained. FIG. 5 is a schematic of the developing unit. FIG. 6 is a plan view of the developing unit 12. As shown in FIG. 5, the developing unit 12 includes the developing roller 17 that is disposed to face the photosensitive element 4 through the opening of the developer case 16, and the doctor blade 18 that restricts the amount of a developer carried on the developing roller 17 inside the developer case 16. In the developer case 16, a first stirring screw 30 as a first developer conveying member, and a second stirring screw 31 as a second developer conveying member are arranged at a position facing the developing roller 17. The developing roller 17 according to the present embodiment includes a magnet roller that includes magnetic poles N1, S1, N2, N3, and S2 in an aluminum sleeve having a diameter of 18 millimeters (mm). The photosensitive element 4 according to the present embodiment rotates at 155 mm/second (sec), and is applied with a voltage of −500 volts (V) at an unexposed part, −50 V at an exposed part, and −350 V as a developing bias.

As shown in FIG. 6, the first stirring screw 30 and the second stirring screw 31 are provided in parallel with the developing roller 17 in the developer case 16. The first stirring screw 30 and the second stirring screw 31 are rotatably supported by bearings (not shown). The developing roller 17 is also rotatably supported by the developer case 16 through bearings (not shown). The first stirring screw 30 and the second stirring screw 31 are separated by a partition wall 32. The first stirring screw 30 is disposed in a first space 33 that is a side from which the developer is supplied to the developing roller 17. The first stirring screw 30 rotates in a direction indicated by an arrow shown in FIG. 5, thereby conveying the developer in the first space 33 from right to left in a direction of length in FIG. 6. The second stirring screw 31 is disposed in a second space 34 in which a toner is replenished from a toner replenishing hole (not shown). The second stirring screw 31 rotates in a direction indicated by an arrow shown in FIG. 5, thereby conveying the developer in the second space 34 from left to right in the direction of length in FIG. 6. A developer transfer part 35 is formed between one end of the partition wall 32 and an internal surface of the developer case 16. The developer is transferred from the first space 33 to the second space 34 through the developer transfer part 35. A developer transfer part 36 is formed between another end of the partition wall 32 and the internal surface of the developer case 16. The developer is transferred from the second space 34 to the first space 33 through the developer transfer part 36. The first stirring screw 30 and the second stirring screw 31 according to the present embodiment have a diameter of 16 mm.

The first stirring screw 30 stirs and conveys the two-component developer in the developer case 1 in the direction from right to left in FIG. 6 toward the developer transfer part 35. The developer is transferred from the transfer part 35 to the second space 34 in which the second stirring screw 31 is disposed. The second stirring screw 31 stirs the two-component developer received in the second space 34, and at the same time, conveys the developer in the direction from left to right in FIG. 6 toward the transfer part 36. The developer is transferred from the transfer part 36 to the first space 33. The first stirring screw 30 stirs the two-component developer received, and at the same, conveys the developer in a direction from right to left in FIG. 6 again. When the developer is stirred and conveyed in this manner, the developer circulates within the developer case 16, and the toner and the carrier contained in the developer are frictionally charged by stirring. The first stirring screw 30 and the second stirring screw 31 rotate at the same speed, thereby conveying substantially the same amount of the developer at the same rate within the developer case 16. As a result, a height of the developer kept in the first space 33 and a height of the developer kept in the second space 34 are substantially the same.

The first stirring screw 30 supplies a part of the developer in the first space 33 to the developing roller 17. The developing roller 17 magnetically holds and conveys the developer. As shown in FIG. 5, the doctor blade 18 controls the height (an amount) of the developer on the developing roller 17, thereby bringing the developer to be in contact with the photosensitive element 4. As a result, when the photosensitive element 4 comes into contact with the developing roller 17, the electrostatic latent image on the photosensitive element 4 is developed and changed into a toner image. The developer remaining on the developing roller 17 after development is removed from the developing roller 17 by a repulsive force of the magnetic poles N2 and N3 in the developing roller 17, and is returned to the first space 33. The first stirring screw 30 stirs and conveys the developer returned. The developer returned is transferred again to the second space 34 through the transfer part 35. When the concentration of the toner in the developer in the developer case 16 becomes equal to or below a predetermined concentration, the toner is replenished from the toner replenishing hole (not shown) to the second space 34. The second stirring screw 31 stirs to mix the toner replenished with the developer in the second space 34. The developing roller 17 holds the developer that is adjusted to a predetermined concentration. The doctor blade 18 controls the height of the developer, and the above cycle is repeated.

According to the present embodiment, the developing unit 12 includes a developer guiding member 37 (a shaded portion shown in FIG. 5) for guiding the developer returned from the developing roller 17 to the first space 33. The developer guiding member 37 guides the developer returned to a position within a range in which rotation of the first conveying unit reaches. The developer guiding member 37 is arranged at an upper portion of the partition wall 32 that faces the first space 33. A surface of the developer guiding member 37 facing the first stirring screw 30 is formed in an arc shape to approximately follow a rotation track of the first stirring screw 30. Existence of the developer guiding member 37 at the portion prevents the developer to be left at a portion in which the developer guiding member 37 is provided. The developer guided is taken into the first stirring screw 30 by the rotation of the first stirring screw 30. Consequently, the developer having low concentration of the toner, which is the toner returned from the developing roller 17 after development, and a developer never used for development are mixed effectively. As a result, the occurrence of the screw pitch unevenness can be suppressed. The developer guiding member 37 is arranged in such a manner that a distance between the developer guiding member 37 and the rotation track of the first stirring screw 30 gradually becomes smaller in a direction in which the first stirring screw 30 rotates. Therefore, the developer guiding member 37 guides the developer dropped on the first space 33 without applying a sudden force to the developer.

An upper surface 37*a* of the developer guiding member 37 is formed in a flat shape continuously with an end 32*a* of the partition wall 32. The end 32*a*, the upper surface 37*a*, and an upper surface 16*a* of a side wall of the developer case 16 form an adhesion surface to which a heat seal 38 as a sealing member is adhered. The heat seal 38 is thermally adhered. The heat seal 38 is applied because it is preferable in terms of hermetic sealing. Before the developer is used, the developer case 16 is sealed with the heat seal 38 by making the heat seal 38 adhere to the upper-surface end 32*a*, the upper surface 37*a*, and the upper surface 16*a*. In other words, the upper-surface end 32*a*, the upper surface 37*a*, and the upper surface 16*a* serve as the adhesion surface. The developing unit 12 according to the present embodiment provides the adhesion surface of the heat seal 38. Therefore, the adhesion surface has a larger area, thereby enabling improved sealing compared to a case in which the adhesion surface is formed with only the end 32*a* of the partition wall 32. Because the upper surface 37*a* of the developer guiding member 37 is used as the adhesion surface, it is not necessary to separately provide the adhesion surface, thereby saving a space. The developer guiding member 37 may be fit to the partition wall 32, or formed integrally with the developer case 16 or the partition wall 32.

It is preferable that the toner has a weight-average particle size of 3 μm to 10 μm. Such toner has a toner particle of which a particle size is sufficiently small for a fine latent-image dot. Therefore, this toner has excellent dot reproducibility. When the weight-average particle size is smaller than 3 μm, it is difficult to clean the toner, and transfer efficiency becomes low. When the weight-average particle size exceeds 10 μm, it becomes difficult to suppress spatter of characters and lines.

A method of measuring a particle size distribution of a toner particle is explained next. A particle size distribution of a toner particle can be measured with a measuring unit according to the Coulter Counter method, for example, the Coulter Counter TA-II and the Coulter Multisizer II (products of Beckman Coulter, Inc.). Specifically, surfactant (preferably alkylbenzene sulfonate) is added by 0.1 mm to 5 mm as dispersant to electrolytic aqueous solution of 100 mm to 150 mm. The electrolytic water solution is about 1% sodium chloride (NaCl) aqueous solution that is prepared by using first class sodium chloride. For example, ISOTON-II (by Beckman Coulter, Inc.) can be used. A measurement sample of 2 milligrams (mg) to 20 mg is further added. An ultrasonic dispersing unit is used to disperse the electrolyte mixed with the sample for about 1 minute to 3 minutes. The measuring unit measures a volume and a number of toner particles or a toner using a 100 μm aperture, thereby calculating a volume distribution and number distribution. A weight-average particle size and a number-average particle size can be obtained from the distributions calculated. The following thirteen channels are used for particles having a particle size equal to or larger than 2.00 μm and smaller than 40.30 μm: there are sizes of; 2.00 μm to 2.52 μm, 2.52 μm to 3.17 μm, 3.17 μm to 4.00 μm; 4.00 μm to 5.04 μm, 5.04 μm to 6.35 μm, 6.35 μm to 8.00 μm; 8.00 μm to 10.08 μm, 10.08 μm to 12.70 μm, 12.70 μm to 16.00 μm, 16.00 μm to 20.20 μm; 20.20 μm to 25.40 μm; 25.40 μm to 32.00 μm, and 32.00 μm to 40.30 μm.

It is preferable that the toner has a spindle shape. A toner having an indeterminate shape or a flat shape has poor powder fluidity, and therefore, has the following problems. Because frictional charging to the toner cannot be smoothly carried out, such toner is likely to cause a background stain. Moreover, the toner has poor dot reproducibility when a latent image having precise dots is to be developed because the toner cannot be arranged precisely and uniformly. Furthermore, when an electrostatic transfer system is used, because the toner cannot receive an influence of lines of electric forces, the toner has poor transfer efficiency. If the toner has a shape close to a true sphere, the toner has too high powder fluidity, and works excessively to external forces. Consequently, at the time of development or image transfer, the toner particles undesirably scatter outside of the dots. If the toner has a spherical shape, toner particles are likely to roll on the photosensitive element, and slip into a space between the photosensitive element and the cleaning member. This causes a cleaning failure. On the other hand, if a toner has a spindle shape, because powder fluidity is properly-adjusted, the frictional charging to the toner can be carried out smoothly, thereby preventing the background stains. The toner having a spindle shape has excellent dot reproducibility. With the toner, precise dots of a latent mage can be developed well, and image transfer is efficiently carried out. The powder fluidity adjusted suitably brakes spattering of the toner particles. Compared with the spherical toner, axes of rotation is limited in the toner having a spindle shape. Therefore, the toner having a spindle shape is less likely to cause a cleaning failure due to slipping into a space between the photosensitive element and the cleaning member.

Figure 7A:
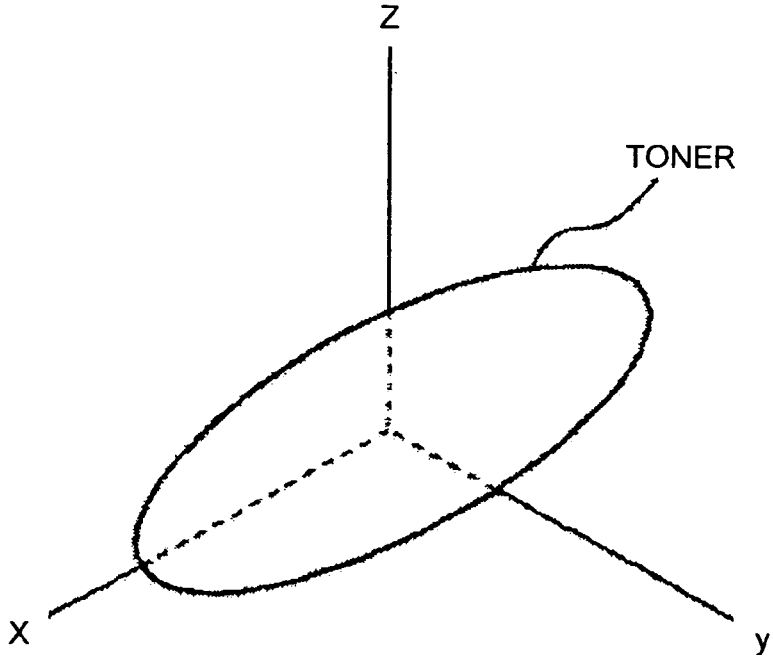
FIG. 7A is a schematic of a shape of a toner expressed on coordinate axes x, y, and z.
Figure 7B:
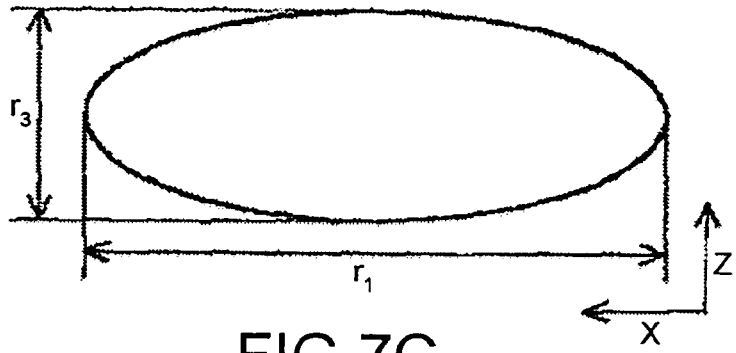
FIG. 7B is a schematic of a shape of a toner expressed on the coordinate axes x, and z.
Figure 7C:
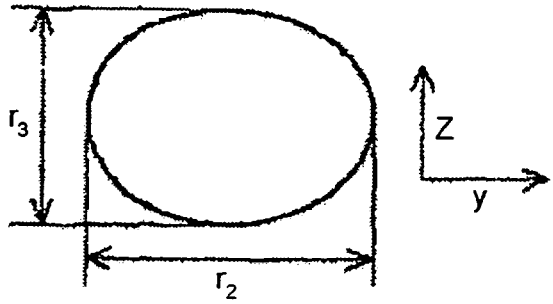
FIG. 7C is a schematic of a shape of a toner expressed on the coordinate axes y, and z.

FIG. 7A is a schematic of a shape of a toner expressed on coordinate axes x, y, and z, FIG. 7B is a schematic of a shape of a toner expressed on the coordinate axes x, and z, and FIG. 7C is a schematic of a shape of a toner expressed on the coordinate axes y, and z. It is preferable that the spindle-shaped toner has a ratio of a length of a long axis r1 to a length of a short axis r2 (r2/r1) to be 0.5 to 0.8, and a ratio of a thickness r3 to the length of the short axis r2 (r3/r2) to be 0.7 to 1.0 as shown in FIGS. 7A, 7B, and 7C. When the toner has a spindle shape having such ratios, a shape of the toner is neither an indeterminate shape, a flat shape, nor a true spherical shape, and the toner having such spindle shape satisfies all of the frictional charging, the dot reproducibility, the transfer efficiency, the spatter prevention, and the cleaning. If the ratio of the long axis r1 to the short axis r2 (r2/r1) is smaller than 0.5, the shape of the toner particle is far from a true spherical shape. Therefore, this toner can be cleaned easily, but has poor dot reproducibility and poor transfer efficiency. Consequently, high-definition image quality cannot be obtained with this toner. When the ratio of the long axis r1 to the short axis r2 (r2/r1) exceeds 0.8, the shape of the toner particle becomes close to the spherical shape. Therefore, a cleaning failure is likely to occur in a low-temperature and a low-humidity environment. When the ratio of the thickness r3 to the length of the short axis r2 (r3/r2) is smaller than 0.7, the toner grain has a shape close to a flat shape. Although this toner hardly spatters unlike the toner having an indeterminate shape, high transfer efficiency of the spherical toner cannot be obtained. Particularly, when the ratio of the thickness r3 to the length of the short axis r2 (r3/r2) exceeds 1.0, the toner particle becomes a rotating body having the long axis as a rotation axis. As a result, a cleaning failure is more likely to occur.

According to the developing unit 12 of the present embodiment, a part of the developer guiding member 37 serves as the adhesion surface to which the heat seal 38 as the sealing member is adhered. Therefore, it is possible to improve hermeticity of the developer case 16 as the developer container while suppressing the screw pitch unevenness.

According to the developing unit 12 of the present embodiment, the weight-average particle size of the toner is 3 μm to 10 μm. Therefore, the toner has toner particles having a sufficiently small particle size, and has excellent dot reproducibility. According to the developing unit of the present embodiment, even though the toner has high fluidity, it is possible to prevent occurrence of toner leakage in the developing apparatus 12, because of a large adhesion area is secured in the developer case 16.

According to the developing unit 12 of the present embodiment, the apparatus uses the spindle-shaped toner, preferably the toner having the ratio of a length of a long axis to a length of a short axis to be 0.5 to 0.8, and a ratio of a thickness to the length of the short axis to be 0.7 to 1.0. Therefore, it is possible to satisfy all of the frictional charging, the dot reproducibility, the transfer efficiency, the spatter prevention, and the cleaning.

According to the present embodiment, the process cartridge 22 integrates the photosensitive element 4, the charging unit 11, the developing unit 12, and the cleaning unit 13, and is arranged detachably to the image forming apparatus main unit. Therefore, maintenance and exchangeability can be improved even when the process cartridge is used for a long period.

According to the present invention, it is possible to provide a developing unit that suppress screw pitch unevenness, and that has improved hermeticity.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developing unit comprising:

a developer carrying member that is in the form of a roller and that carries a first developer that contains a toner and a carrier;

a developer container that includes an opening and holds the first developer; a developer controlling member that controls an amount of a second developer that is a part of the first developer to be supplied from the developer container to the developer carrying member;

a first conveying member that is in the form of a roller, that is rotatably arranged in the developer container and substantially parallel to the developer carrying member, and that stirs and conveys the first developer in the developer container to the developer carrying member;

a second conveying member that is in the form of a roller, that is rotatably arranged in the developer container and substantially parallel to the first conveying member, and that stirs and conveys the first developer to a direction opposite to a direction to which the first conveying member conveys the first developer; and a partition wall arranged between the first conveying member and the second conveying member, wherein the partition wall includes a guiding member that guides, to a position within a range in which rotation of the first conveying member reaches, a third developer that is a part of the second developer returned after being used for development from the developer carrying member, and the developing unit includes a sealing member for sealing the opening and adhered to at least a part of the guiding member.

2. The developing unit according to claim 1, wherein a weight-average particle size of the toner is 3 micrometers to 10 micrometers.

3. The developing unit according to claim 1, wherein the toner has a spindle shape.

4. The developing unit according to claim 3, wherein the toner has a ratio of a length of a long axis r1 to a length of a short axis r2 to be from 0.5 to 0.8, and a ratio of a thickness r3 to the length of the short axis r2 to be from 0.7 to 1.0.

5. A process cartridge that is used for an image forming apparatus, the image forming apparatus including an image carrier that carries an image; a charging unit that uniformly charges the image carrier; a developing unit that develops a latent image on the image carrier; and a cleaning unit that cleans a residual toner remaining on the image carrier after development, wherein the process cartridge integrates the developing unit with at least one of the image carrier, the charging unit, and the cleaning unit, the process cartridge is detachable to the image forming apparatus, and the developing unit includes:

a developer carrying member that is in the form of a roller and that carries a first developer that contains a toner and a carrier;

a developer container that includes an opening and holds the first developer;

a developer controlling member that controls an amount of a second developer that is a part of the first developer to be supplied from the developer container to the developer carrying member;

a first conveying member that is in the form of a roller, that is rotatably arranged in the developer container and substantially parallel to the developer carrying member, and that stirs and conveys the first developer in the developer container to the developer carrying member;

a second conveying member that is in the form of a roller, that is rotatably arranged in the developer container and substantially parallel to the first conveying member, and that stirs and conveys the first developer to a direction opposite to a direction to which the first conveying member conveys the first developer; and a partition wall arranged between the first conveying member and the second conveying member, wherein the partition wall includes a guiding member that guides, to a position within a range in which rotation of the first conveying member reaches, a third developer that is a part of the second developer returned after being used for development from the developer carrying member, and the developing unit includes a sealing member for sealing the opening and adhered to at least a part of the guiding member.

6. An image forming apparatus comprising:

an image carrier;

an image forming unit that forms a latent image on the image carrier; and a developing unit that develops the latent image, wherein the developing unit includes:

a developer carrying member that is in the form of a roller and that carries a first developer that contains a toner and a carrier;

a developer container that includes an opening and holds the first developer;

a developer controlling member that controls an amount of a second developer that is a part of the first developer to be supplied from the developer container to the developer carrying member;

a first conveying member that is in the form of a roller, that is rotatably arranged in the developer container and substantially parallel to the developer carrying member, and that stirs and conveys the first developer in the developer container to the developer carrying member;

a second conveying member that is in the form of a roller, that is rotatably arranged in the developer container and substantially parallel to the first conveying member, and that stirs and conveys the first developer to a direction opposite to a direction to which the first conveying member conveys the first developer; and a partition wall arranged between the first conveying member and the second conveying member, wherein the partition wall includes a guiding member that guides, to a position within a range in which rotation of the first conveying member reaches, a third developer that is a part of the second developer returned after being used for development from the developer carrying member, and the developing unit includes a sealing member for sealing the opening and adhered to at least a part of the guiding member.

* * * * *